United States Patent [19]

Boehlke et al.

[11] 4,231,854

[45] Nov. 4, 1980

[54] ANODE FOR CATHODIC ELECTROCOATING

[75] Inventors: Klaus Boehlke, Hessheim; Fritz E. Kempter, Mannheim, both of Fed. Rep. of Germany

[73] Assignee: BASF Aktiengesellschaft, Ludwigshafen, Fed. Rep. of Germany

[21] Appl. No.: 951,565

[22] Filed: Oct. 16, 1978

[30] Foreign Application Priority Data

Oct. 21, 1977 [DE] Fed. Rep. of Germany ..... 2747334

[51] Int. Cl.[3] ..... C04B 35/26; C04B 35/54; C25B 11/12; C25B 11/16

[52] U.S. Cl. ..... 204/294; 204/291; 264/105; 264/104

[58] Field of Search ..... 204/290 R, 291, 294; 264/105, 320, 104

[56] References Cited

U.S. PATENT DOCUMENTS

| | | | |
|---|---|---|---|
| 3,318,794 | 5/1967 | Kiyohara et al. | 204/290 R |
| 3,507,773 | 4/1970 | Grangaard et al. | 204/294 |
| 3,619,286 | 11/1971 | Gutnajer | 204/290 R |
| 3,753,885 | 8/1973 | Hammond | 204/181 |

FOREIGN PATENT DOCUMENTS 1227405 4/1971 United Kingdom .

*Primary Examiner*—Howard S. Williams
*Attorney, Agent, or Firm*—Keil & Witherspoon

[57] ABSTRACT

Novel anodes consist of a mixture of from 30 to 95% by weight of nagnetite, lead dioxide, magnetite/natural graphite mixture or lead dioxide/natural graphite mixture and from 70 to 5% by weight of a plastic. They may be used for the surface-coating of metallic substrates by cathodic electrocoating.

14 Claims, No Drawings

ANODE FOR CATHODIC ELECTROCOATING

The present invention relates to anodes for cathodic electrocoating and to a process for the electrocoating of metallic substrates using such anodes.

Electrocoating is a well-proven process for the surface-coating of metallic substrates, for example of automotive bodywork panels. In cathodic electrocoating, a cationic binder is used, which is deposited together with the pigment on the metal panel wired as the cathode. Hitherto, graphite anodes were used virtually exclusively as the counter-electrodes.

Graphite anodes are in general manufactured by sinter-molding at around 2,000° C. This is a troublesome and expensive process. The anodes thus produced are of relatively low strength and their machinability by drilling, cutting or milling is not entirely satisfactory. Furthermore, they are rather porous, which can lead to difficulties on prolonged operation of the electrocoating baths.

It is an object of the present invention to provide anodes which can be manufactured simply and cheaply and which do not suffer from the above mechanical disadvantages. Furthermore, such anodes should be at least equivalent to conventional graphite electrodes in respect of their suitability for electrocoating. In addition, they should show a longer life than graphite/plastic anodes, and exhibit no wear due to oxidation or corrosion.

According to the invention there is provided an anode for cathodic electrocoating, which comprises a mixture of (A) from 30 to 95% by weight of magnetite, lead dioxide, a magnetite/natural graphite mixture or a lead dioxide/natural graphite mixture, and (B) from 70 to 5% by weight of a plastics material.

Components (A) are magnetite, lead dioxide, mixtures of magnetite and natural graphite and mixtures of lead dioxide and natural graphite; the mixtures of magnetite or lead dioxide and natural graphite may in general contain up to 90% by weight, but preferably contain only up to 50% by weight, of natural graphite. Magnetite is the particularly preferred component (A).

To manufacture the anodes of the invention, magnetite or lead dioxide, with or without natural graphite, is suitably used as a very fine powder with particle diameters of $<0.3$ mm, preferably of $<0.1$ mm. The anodes of the invention contain component (A) in an amount of from 30 to 95% by weight, preferably from 60 to 90% by weight.

Plastics materials (B) which may be used are polymers, polycondensates and polyadducts, preferably thermoplastics, which soften at from 50° to 250° C. and are moldable at this temperature without, however, decomposing. It is advantageous to use plastics materials which are resistant to oxidation and to hydrolysis.

Particularly suitable plastics materials are homopolymers and copolymers of ethylenically unsaturated organic compounds, such as olefin polymers, eg. polyethylene or polypropylene, styrene polymers, eg. polystyrene or high-impact polystyrene, chlorine-containing polymers, eg. polyvinyl chloride, polyvinylidene chloride and chlorinated polyolefins, polymethyl methacrylate and polyacrylates. Polycondensates and polyadducts, eg. nylon, polyesters of aromatic dicarboxylic acids and saturated diols, polycarbonates and polyacetals may also be used. Of course, mixtures of the said plastics materials can also be employed.

The anodes can be manufactured in a very simple manner for example the solid, finely divided starting materials are mixed, the mixture is heated to 100°-300° C., preferably to 150°-250° C., advantageously in an extruder, and a homogeneous mixture is thus obtained which can now be extruded, cooled and granulated. The resulting granules can be compression-molded to any desired shape at from 100° to 300° C., under pressures of from 10 to 400 kg/cm$^2$, using residence times of from 2 to 40 minutes. It is also possible to press the well-dispersed mixture of the starting materials, whilst still hot after extrusion, directly to the desired shape between endless belts.

Sheets or rods from 0.3 to 30 mm thick and from 30 cm to 5 m long are preferred as the form of the anodes. The materials in general have an electrical conductivity of from $10^{-3}$ (i.e. 0.001) to 1 S/cm; their strength, measured according to DIN 53,455, is in general from 30 to 200 kp/cm$^2$. They can easily be machined, for example by cutting, milling and drilling, and this is an advantage in preparing them for the special requirements of each particular electrocoating bath. Furthermore, the materials have a smooth, non-porous surface.

A particular advantage of the anodes according to the invention, containing magnetite or lead dioxide, is their substantially better corrosion resistance and oxidation resistance and their significantly increased life.

The process of cathodic electrocoating is known. The cathode consisting of the substrate to be coated, and an anode, these electrodes being connected to one another by an electric circuit, are dipped into an aqueous bath which contains a cationic organic binder, a pigment and optionally one or more additives, e.g. the conventional additives. The voltage applied is usually from 50 to 500, preferably from 100 to 400, volts and the solids content of the bath is in general from 5 to 20, preferably from 10 to 15%, by weight. The weight ratio of binder to pigment can vary from 1:0.1 to 1:0.4; the pH of the bath is in general from 4 to 9, preferably from 5 to 8.5. The cationic organic binders used contain positively charged groups, eg. quaternary ammonium groups or sulfonium groups. For example, acrylic ester polymers which contain alkylamino groups (German Published Applications DAS No. 1,546,840 and DAS No. 1,546,848) or imidazole groups (German Published Application DAS No. 1,276,260) in the molecular structure can be used. Mixtures of polyfunctional aminoalcohols containing a tertiary nitrogen atom, a long-chain monocarboxylic acid, a polycarboxylic acid and a phenoplast or aminoplast resin as described in German Laid-Open Application DOS No. 1,930,949 are also suitable. Epoxy resins based on reaction products of a polyepoxide and a hydroxyl-containing secondary or tertiary amine, as described in German Laid-Open Application DOS No. 2,033,770, and mixtures of amino-containing organic binders and blocked polyisocyanates, as described in German Laid-Open Application DOS No. 2,057,799, may also be employed. Reaction products of epoxy resins with Mannich bases obtained from condensed phenols, a secondary amine containing a hydroxyalkyl group and formaldehyde, as described in German Laid-Open Applications DOS No. 2,320,301 and DOS No. 2,357,075, are also very suitable binders.

In addition to the binder and the pigment, the electrocoating baths may contain additives of the conventional types, eg. fillers, solvents, flow control agents, dispersants, stabilizers, anti-foam agents and baking catalysts.

The conventional metallic substrates for surface-coating are suitable substrates, eg. iron and steel panels, which may or may not be chemically pre-treated, eg. phosphatized.

In the Examples, parts and percentages are by weight.

EXAMPLE 1

(a) Preparation of an electrode

An 0.6 cm thick and 30 cm wide web of a mixture of 30 parts of polypropylene (density 0.908 g/cm$^2$; melt index about 2.5 g/10 minutes) and 70 parts of magnetite powder is extruded at 250° C. The plastic mixture is compressed in a pressure zone by means of endless steel belts, using a pressure of about 5 bar. The residence time in the pressure zone is about 2 minutes. The finished extruded sheet, which is 4 mm thick, leaves the pressure zone via cooled rollers and is then cut to the desired sheet lengths. The electrical conductivity of the sheets is $10^{-3}$ S/cm. The strength of the sheets is measured according to DIN No. 53,455 and is 150 kp/cm$^2$. The E-modulus, measured as described in DIN 53,457, is 10,000 N/mm$^2$. An electrode is prepared similarly from lead dioxide powder and polypropylene and exhibits substantially the same properties.

(b) Electrocoating

The electrode prepared as described in (a) is applied to 6 l of a cationic electrocoating finish containing the binder of German Laid-Open Application DOS No. 1,930,949, Example 1, pigmented with red iron oxide (the binder:pigment ratio being 1:0.2); the electrode surface exposed to the bath is about 150 cm$^2$. Untreated steel panels are provided with coatings in 2 minutes in this bath at 30° C. and pH 4.5, using a voltage of from 170 to 180 V, without employing a series resistor; these coatings do not differ in quality from those of Example 1 of German Laid-Open Application DOS No. 1,930,949. The life of the electrode is twice that of graphite electrodes, and the electrode surface remains smooth.

EXAMPLE 2

A mixture of 10 parts of polypropylene and 90 parts of magnetite is converted to sheets as described in Example 1. These sheets have an electrical conductivity of 0.5 S/cm, a strength of 100 kp/cm$^2$ and a E-modulus of 20,000 N/mm$^2$.

EXAMPLE 3

(a) Preparation of an electrode

A mixture of 20 parts of an ethylene polymer (density 0.96 g/cm$^3$, melt index 4.5 g/10 minutes) and 80 parts of magnetite is converted to sheets as described in Example 1. These sheets have an electrical conductivity of $10^{-2}$ S/cm, a strength of 70 kp/cm$^2$ and a E-modulus of 8,000 N/mm$^2$. An electrode prepared similarly from a mixture of 40 parts of magnetite, 40 parts of natural graphite and 20 parts of polyethylene has a conductivity of 0.1 S/cm and an E-modulus of 13,000 N/mm$^2$.

(b) Electrocoating

The electrode prepared as described in (3a) is applied to 6 l of a cationic electrocoating bath as described in Example 3 of German Laid-Open Application DOS No. 2,357,075. The electrode surface exposed to the bath is about 150 cm$^2$. Phosphatized steel panels are provided with coatings in 2 minutes in this bath at 30° C. and pH 8.6, using a voltage of 280 V, without employing a series resistor.

The life of the anode prepared as described in (3a) corresponds to that prepared as described in Example (1a), and once again the surface remains smooth.

We claim:

1. An anode for cathodic electrocoating, which comprises a mixture of (A) from 60 to 90% by weight of magnetite or a magnetite/natural graphite mixture and (B) from 40 to 10% by weight of a plastic.

2. An anode as claimed in claim 1, wherein component B is a homopolymer or copolymer of an ethylenically unsaturated organic compound which softens, and is moldable, at from 50° to 250° C., without decomposing.

3. An anode as claimed in claim 1, which has an electrical conductivity of from 0.001 to 1 S/cm.

4. An anode as claimed in claim 1, wherein component (A) is employed in a finely divided form, with a particle diameter of less than 0.3 mm.

5. An anode as claimed in claim 1, which has been prepared by mixing components (A) and (B) at from 100° to 300° C. in an extruder and then molding the mixture.

6. An anode as claimed in claim 1, wherein component (B) is an olefin polymer.

7. An anode as claimed in claim 1 wherein said plastic is a thermoplastic synthetic polymer having a softening point between 50° C. and 250° C., at which softening point the polymer does not decompose.

8. An anode as claimed in claim 7, wherein component A is magnetite.

9. An anode as claimed in claim 7, wherein component A is magnetite or a magnetite/natural graphite mixture containing up to 50% by weight of natural graphite.

10. An anode as claimed in claim 7, wherein said anode is in the form of a large, thin sheet.

11. An anode as claimed in claim 8, wherein said anode is in the form of a large, thin sheet.

12. A process for producing an anode for the electrocoating of metallic substrates in which the substrate, which has been made the cathode, and the anode are dipped into an aqueous bath which contains a heat-curable cationic organic binder, pigments and further additives, wherein the anode consists of a mixture of (A) from 30 to 95% by weight of magnetite, lead dioxide, a magnetite/natural graphite mixture or a lead dioxide/natural graphite mixture and (B) from 70 to 5% by weight of homo- or copolymers of ethylenically unsaturated organic compounds, which process comprises:

(1) mixing finely divided components (A) and (B) in an extruder, (2) heating this mixture to a temperature of from 100° to 300° C., (3) extruding the mixture, (4) cooling and granulating the extrudate, and (5) compression-molding the granules to form the anode.

13. A process as claimed in claim 12, wherein said mixture consists essentially of magnetite and a thermoplastic synthetic polymer having a softening point between 50° C. and 250° C., at which softening point the polymer does not decompose.

14. A process as claimed in claim 12, wherein said granules are compression molded into large, thin sheets.

* * * * *